US005090787A

United States Patent [19]

Harley

[11] Patent Number: 5,090,787

[45] Date of Patent: Feb. 25, 1992

[54] DRAWER RUNNER

[75] Inventor: David N. Harley, Dorset, England

[73] Assignee: Titus Tool Company Limited, Iver, England

[21] Appl. No.: 767,213

[22] Filed: Mar. 19, 1991

Related U.S. Application Data

[63] Continuation of Ser. No. 142,553, Jan. 11, 1988, abandoned.

[30] Foreign Application Priority Data

Jan. 12, 1987 [GB] United Kingdom ..... 8700580

[51] Int. Cl.[5] ..... A47B 88/16

[52] U.S. Cl. ..... 312/348; 312/344.1; 384/20

[58] Field of Search ..... 312/330.1, 338, 348, 312/350, 341.1, 340, 344.1; 384/20, 21

[56] References Cited

U.S. PATENT DOCUMENTS

| | | | |
|---|---|---|---|
| 4,212,503 | 4/1978 | Litchfield et al. | 312/348 |
| 4,453,790 | 9/1982 | Cohen et al. | 312/348 |
| 4,765,699 | 2/1987 | Bessinger et al. | 312/348 |

FOREIGN PATENT DOCUMENTS

| | | | |
|---|---|---|---|
| 2603753 | 8/1977 | Fed. Rep. of Germany | 312/348 |
| 2707365 | 8/1978 | Fed. Rep. of Germany | 312/348 |
| 2847459 | 5/1980 | Fed. Rep. of Germany | 312/348 |
| 2927611 | 1/1981 | Fed. Rep. of Germany | 312/348 |
| 3034609 | 3/1982 | Fed. Rep. of Germany | 312/348 |

*Primary Examiner*—Kenneth J. Dorner
*Assistant Examiner*—Brian K. Green
*Attorney, Agent, or Firm*—Lowe, Price, LeBlanc & Becker

[57] ABSTRACT

A drawer slide arrangement for smoothly sliding a drawer in and out of a cabinet comprises a runner firstly adapted to be secured to at least one side of a cabinet and including an end-stop 44 and a steering wall 58. The arrangement further comprising a retaining guide 32 adapted to be mounted on the complementary side of the drawer and projecting into a groove 20 on the drawer side. In use, the retaining guide 32 co-operates with the end-stop 44, to prevent accidental removal of the drawer, and with the steering wall 58, to substantially limit transverse movement of the drawer relative to the cabinet.

6 Claims, 4 Drawing Sheets

DRAWER RUNNER

This application is a continuation of application Ser. No. 07/142,553 filled Jan. 11, 1988, now abandoned.

The invention relates to a drawer runner for use with drawers including longitudinal grooves in the side panels.

It is known to use low-friction runners mounted on a cabinet carcass or other housing and sliding in the grooves cut into the sides of a drawer. This simple and inexpensive arrangement has proved practical only for drawers of light construction containing small or relatively light loads. A major problem with a sliding arrangement is that there is no means for preventing the drawer from being removed completely from the cabinet carcass or other housing. Unintentional removal of the drawer can result in damage to the drawer and its contents, and could also cause injury to the user. Those arrangements which have included means for preventing unintentional removal of the drawer have hitherto been arranged such that intentional removal of the drawer has not been possible without unscrewing or otherwise demounting the stop arrangement from the drawer or carcass. Another associated problem is that the drawer is unguided, that is the movement of the drawer is not limited to only in and out of the cabinet carcass or other housing, but also the drawer can move transversely within the housing. Such transverse movement, generally referred to as "racking" by those skilled in the art of drawer manufacture, is undesirable since it is a common occurrance for a drawer to jam aslant in the cabinet carcass or other housing which can result in damage to the drawer assembly, the housing, or even the contents of the drawer. Moreover, an absence of stopping means to prevent accidental removal and guiding means to reduce racking are generally associated with cheap and poorly manufactured furniture by the buying public, and hitherto it has not been possible to employ a cheap sliding arrangement which provides both stopping and guiding functions.

The effect of racking can be reduced by inter-alia ensuring that the gap between the drawer and the cabinet carcass or other housing is comparatively small. However, this reduction in manufacturing tolerance leads to an inevitable increase in production costs which makes this approach undesirable in the production of mass-market furniture.

Alternative arrangements are also known which include on each side of a drawer: a first guide member secured to the drawer, a second co-operating guide member secured to the cabinet carcass or other housing, and rollers or other free moving load bearing arrangements supporting the weight of the drawer and its contents and located between the two co-operating guide members. These arrangements usually include a stop preventing the user from unintentionally removing the drawer from the cabinet carcass or other housing thus preventing the inconvenience of the drawer and its contents from falling and being damaged.

Such guide arrangements permit exceptionally easy operation of a drawer and limit the extent to which the drawer may be opened in normal use. These characteristics are usually achieved by pre-shaping the co-operating members and/or configuring the cooperating members and the load bearing arrangements in a predetermined manner during assembly. By careful design the problem of "racking" can also be reduced to an acceptable level.

The use of a low friction load bearing arrangement to support the weight of the drawer between the two guide members has been shown to give satisfactory operation and to enable easy handling of drawers containing heavy loads. However, such constructions are expensive to manufacture due to the number of discrete components and due to the time spent in assembling such arrangements. This is a particular disadvantage with goods produced for a mass-market which must be as cheap as possible whilst still achieving the aforementioned desirable characteristics.

The invention aims to overcome the above and associated problems by providing a drawer runner system which is simple and, therefore, cheap to produce.

According to the present invention there is provided an arrangement for smoothly guiding a drawer in and out of a cabinet comprising:

an elongate member secured to at least one side of the cabinet, the elongate member including a stop means at an end portion thereof, a sliding surface, and a rib extending from an edge portion thereof; and a projecting member mounted on a complementary side of the drawer so as to contact the sliding surface thereby to at least partially support the weight of the drawer, which member cooperates with the stop means to limit opening of the drawer to a predetermined position and with the rib to substantially limit transverse movement of the drawer relative to the cabinet.

A cut-away portion is advantageously provided in the elongate guiding means such that the projecting member may be lifted clear of the stop means by lifting the front of the drawer, thus allowing removal of the drawer from the aperture.

In the preferred embodiment, the guide is secured to at least one side of the drawer above a channel running along the length of the side of the drawer, which channel cooperates with the elongate guiding means to support the remaining weight of the drawer; the guide and the channel cooperating with the elongate guiding means to substantially limit transverse movement of the drawer relative to the cabinet.

According to another aspect of the present invention there is provided a cabinet arranged to accommodate a drawer and including an arrangement for smoothly guiding the drawer in and out of the cabinet, the arrangement comprising:

an elongate member secured to at least one side of the cabinet, the elongate member including a stop means at an end portion thereof, a sliding surface, and a rib extending from an edge portion thereof; and a projecting member mounted on a complementary side of the drawer so as to contact the sliding surface thereby to at least partially support the weight of the drawer, which member cooperates with the stop means to limit opening of the drawer to a predetermined position and with the rib to substantially limit transverse movement of the drawer relative to the cabinet.

According to yet another aspect of the present invention there is provided a drawer runner arrangement comprising: bearing and steering means for mounting on each side of a drawer, and sliding and guiding means for mounting on corresponding inner sides of a cabinet carcass, in which the bearing and steering means on the drawer cooperate with the sliding and guiding means on the cabinet carcass in use to substantially limit transverse movement of the drawer relative to the cabinet carcass and the sliding and guiding means are adapted to provide a stop means which cooperates with the bearing and steering means on each drawer side in use to limit outward movement of the drawer.

An embodiment of the invention will now be described by way of example, with reference to the accompanying drawings in which.

Figure 4A:
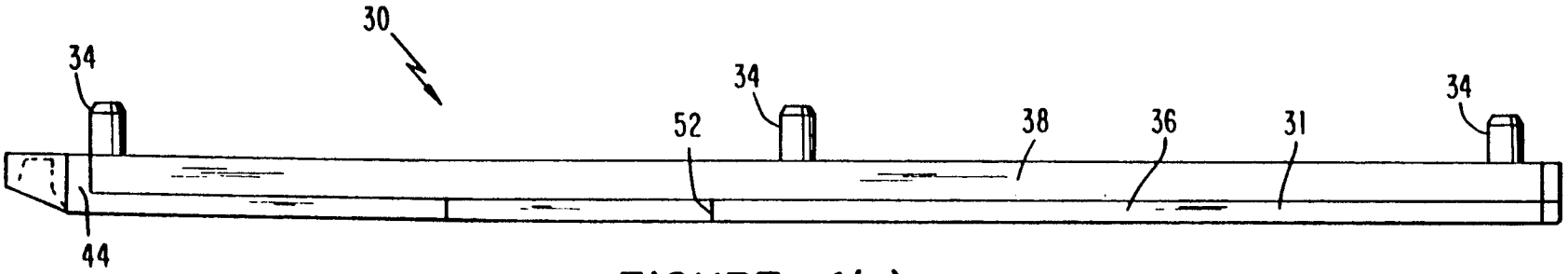
Figure 4B:
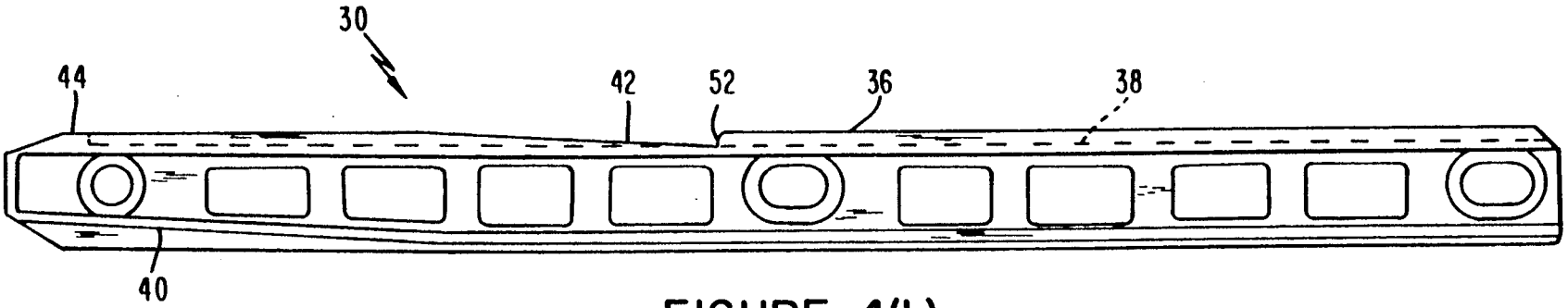

FIGS. 4(*a*) and 4(*b*) are plan and side elevations respectively of a runner according to the invention.

Figure 1:
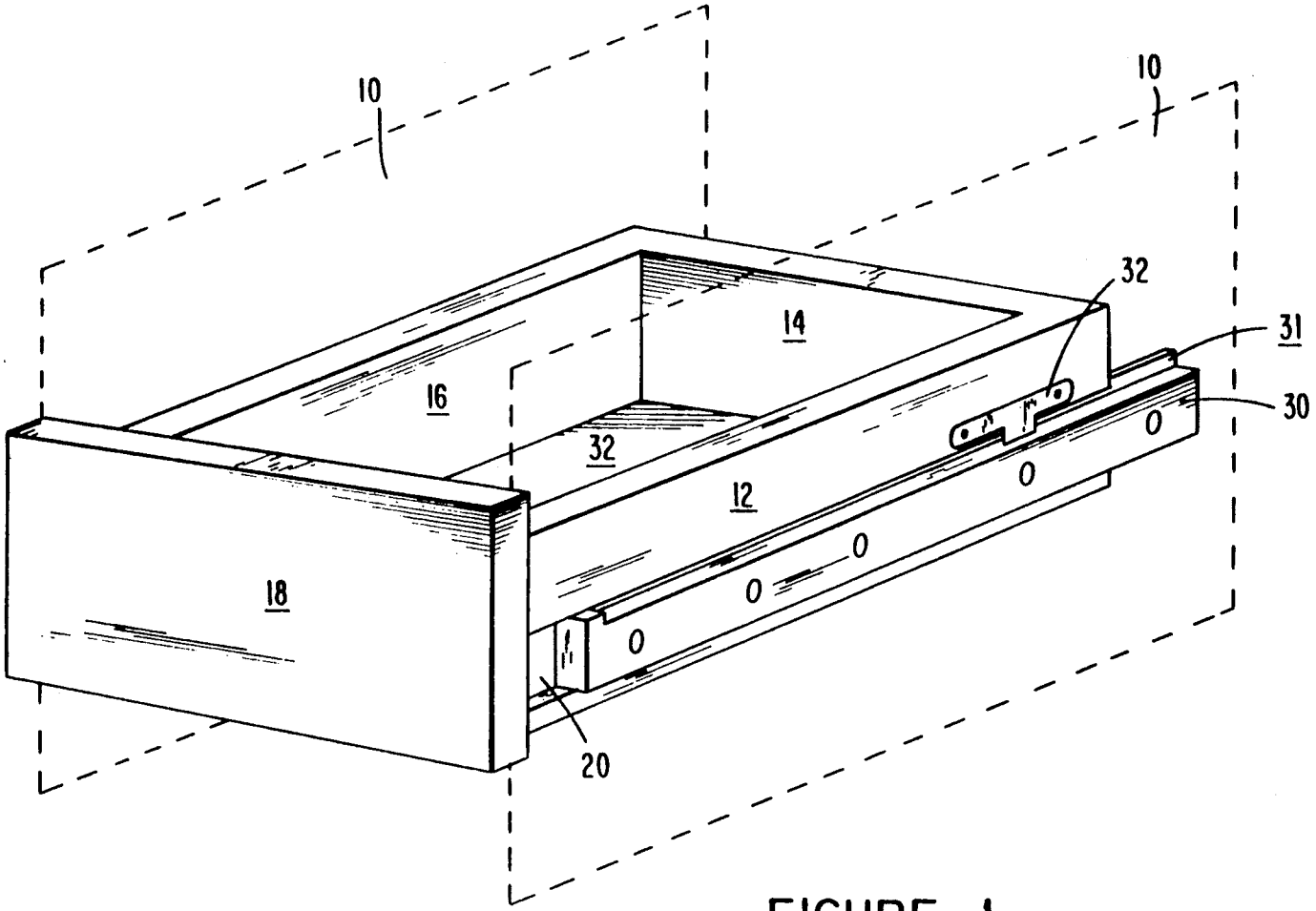
FIG. 1 is a schematic perspective view of a runner system according to the present invention.

Referring now to FIG. 1 of the drawings, the side walls 10 of the cabinet, represented by the broken lines in the drawing, form a drawer-accommodating opening in a piece of furniture. The side walls 12, 16 and end wall 14 of the drawer are preferably formed as a single part by the vinyl-wrapped method, as is well known to those skilled in the art, and include a groove 20 on the outer surfaces of at least the side walls 12, 16 extending along the length of the side walls 12, 16. A base 22 is secured to the walls 12, 14, 16 by known methods, and the free ends of the side walls 12, 16 are secured to a front panel 18 by known methods. The front panel 18 is of greater width than the distance between the two cabinet walls 10 so as to ensure that the drawer assembly will stop moving into the cabinet once the inner face of the front panel 18 contacts the front edges of the cabinet walls 10.

The sliding arrangement comprises a nylon runner 30 which is secured to the cabinet side wall 10 and a retaining guide 32 which is a projecting member secured to the outer surface of the drawer side wall 12. Retaining guide 32 includes first, second and third parts corresponding to bearing surface 60, stopping face 48 and steering projection 56, respectively, each of which cooperate with nylon runner 30 to support, guide, and limit travel of the drawer. The first, second and third parts of retaining guide 32 are all located within a region which extends along only a minor portion of the length of the drawer.

FIG. 1 shows one sliding arrangement on the drawer side wall 12. It will be appreciated by those skilled in the art that a similar arrangement may be provided on the other drawer side wall 16, although this may require a compromise between the guiding and the stopping functions hereinafter described. It will also be appreciated that although the retaining guide 32 is substantially T-shaped in this embodiment other forms could easily be used to serve the same functions hereinafter described.

Referring now to FIG. 4, the runner 30 includes securing studs 34 which are inserted into pre-drilled holes, not shown, in the cabinet, the pre-drilled holes being of suitable diameter to provide a interference fit when the securing studs 34 are inserted into them thus making subsequent removal of the slide 30 difficult. Alternatively, the runner 30 may be formed to accommodate screws to secure the runner to the cabinet. The retaining guide 32 can be fixed to the drawer side-wall in a similar manner to that just described for the slide. The top of the runner 30 includes a sliding surface 36 on a rib 31 and a second sliding surface 38. The sliding surface 36 includes an angled cut-away section 42 which runs parallel to a similarly angled cut-away section 40 on a lower surface of the slide 30, and an end-stop 44.

Figure 2:
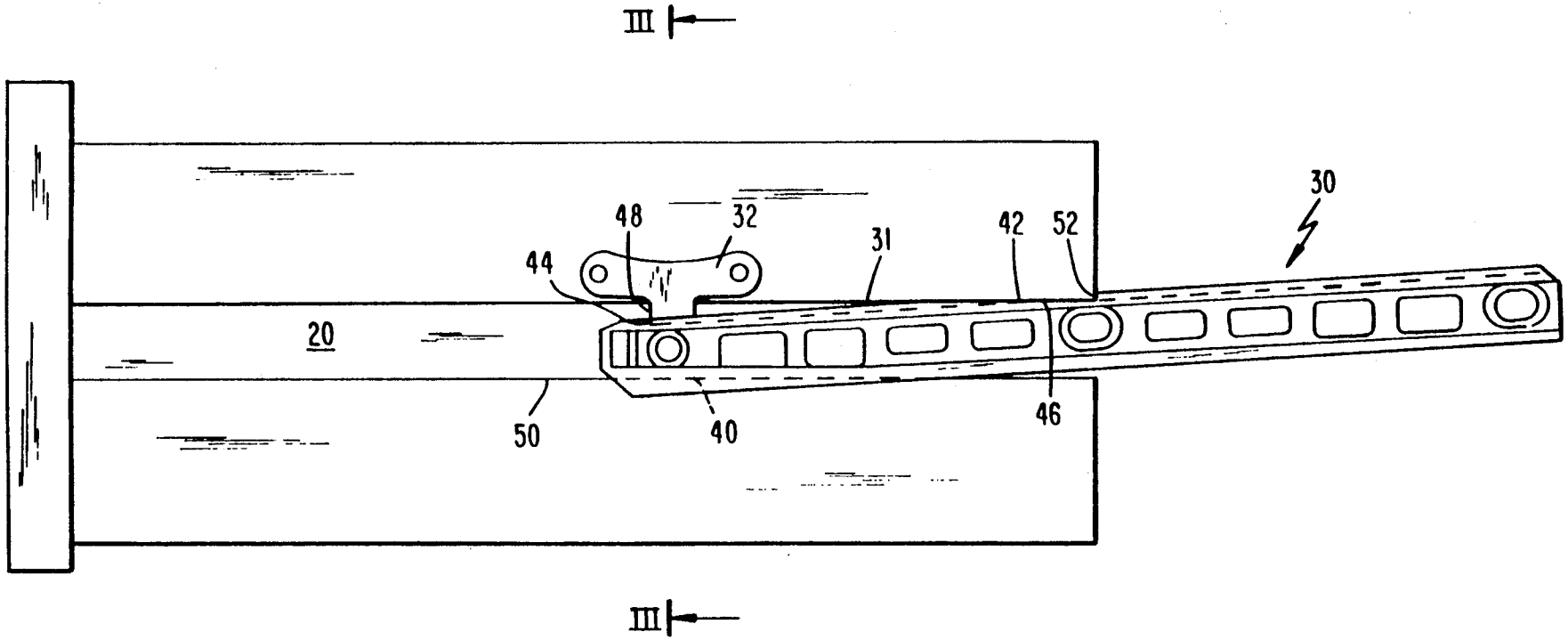
FIG. 2 is a side view of a runner system according to the invention with the drawer front raised prior to moving a retaining guide past an end-stop.

As can be seen from FIG. 2, when the drawer front is not tilted upwards the end-stop 44 will co-operate with the retaining guide 32 to prevent accidental removal of the drawer from the runner 30. To remove the drawer from the cabinet the retaining guide 32 must be lifted clear of the end-stop 44 as is shown. This may be achieved by the user lifting up the front of the drawer so that a portion 46 of the upper face at the rear of the drawer groove 20 moves down into the cutaway section or recess 42 of the runner 30. Simultaneously, a portion of the lower face 50 of the groove 20 moves towards the cut-away section 40 on the lower surface of the runner 30. In this position the retaining guide 32 lifts clear of the end-stop 44 allowing the user to remove the drawer from the cabinet. In this respect it is important that the distance between the retaining member 32 and the openend of the groove 20 is less than the distance between the end-stop 44 and the end 52 of the cut-away section 42. Although precise positioning of the parts is not essential for satisfactory operation of the invention it will be readily apparent that the length between the stopping face 48 of the retaining member 32 and the rear of the groove 20 must be no greater than the length between the end-stop 44 and the end 52 of the cut-away section 42.

Figure 3:
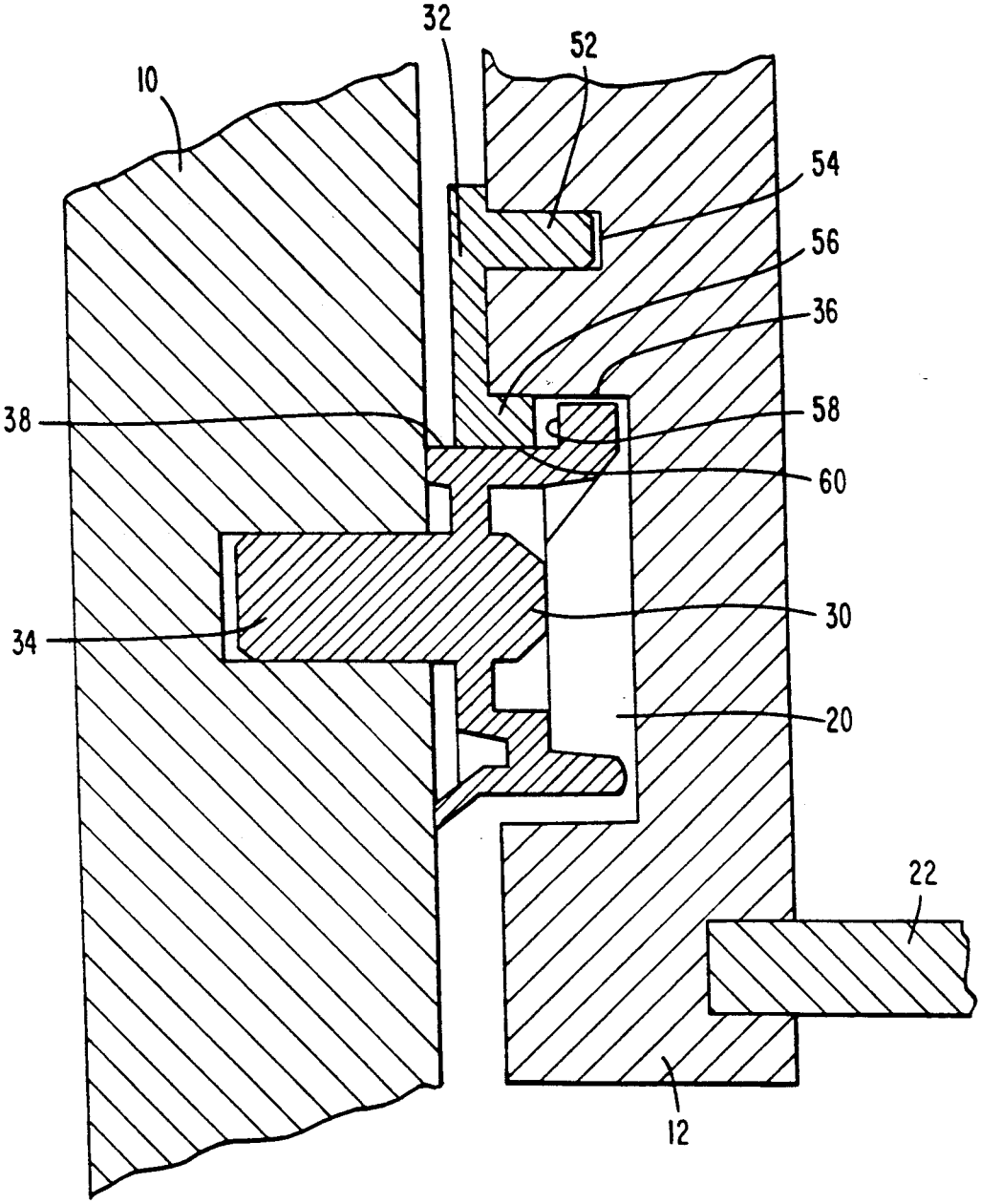
FIG. 3 is a section view of the system in FIG. 2 taken along the line III—III.

The relationship between the cabinet walls 10, the drawer walls 12, the runner 30 and the retaining guide 32 is best shown in FIG. 3 which shows a partial section through the line III—III in FIG. 2. The retaining guide 32 is secured to the drawer side-wall 12 by a suitable securing means which, in the embodiment illustrated, is a stud 52 dimensioned to provide an interference fit in a pre-drilled hole 54 suitably positioned above the groove 20. The retaining guide 32 includes a steering projection 56 which projects partially into the groove, 20 and co-operates with a steering wall 58 on the side of rib 31 extending perpendicular from the sliding surface 38 to the sliding surface 36 on rib 31 of runner 30 in use, to limit the degree of transverse movement of the drawer within the cabinet walls, thus reducing the degree of racking in the drawer. The retaining guide 32 also includes a bearing surface 60 which contacts the sliding surface 38 on the runner in use, thus providing a bearing surface which supports at least part of the weight of the drawer in use.

In use the drawer is protected against accidental removal from the cabinet since movement of the retaining guide 32 along the sliding surface 38 is limited by the end-stop 44 thus limiting the opening movement of the drawer. As already described hereinabove, the retaining guide 32 can be moved forward past the end-stop 44 simply by lifting the drawer front upwards once the end-stop is reached and pulling the drawer forward out of the cabinet. In use, the weight of the drawer is sufficient to ensure that the retaining guide 32 and the end-stop 44 co-operate to prevent accidental removal of the drawer from the cabinet.

It will be apparent to those skilled in the art that accidental removal of the drawer is best prevented by providing an end-stop and retaining guide on each side of the drawer, the arrangement on both sides being suitably positioned so that both end-stops are operative when the drawer is opened to its fullest allowable extent. If only one arrangement is provided the user may inadvertently force the retaining guide against the end-stop thereby pulling the drawer aslant which may result in the end-stop or the drawer being damaged or in the drawer being jammed in the cabinet. However, a desired reduction in racking and generally improved opening and closing of the drawer is best achieved by simply fitting the described runner to only one side of the drawer and complementary wall on the cabinet, and providing a supporting surface only to support the other side of the drawer. This arrangement will substantially reduce racking and generally improve the operation of the drawer. Ideally, therefore, the preferred embodiment of the invention should provide stopping means on both sides of the drawer, and guiding means on only one side of the drawer. However, in practice the cost of supplying unique components for each side may be prohibitive in which case a compromise will have to be reached in which either the efficiency of the guiding function or of the stop function is reduced.

This invention offers a number of advantages over the prior art. The end-stop and the drawer release arrangement have hitherto either not existed at all in a drawer sliding system or have been so arranged that removal of the drawer is not possible without unscrewing or otherwise demounting the end stop from the drawer or carcass. The invention also provides both stopping and guiding functions in a single arrangement which has hitherto not been possible. Moreover, the advantages offered by the slide arrangement may be achieved with only two components ie. the slide and the retaining guide suitably mounted in the cabinet carcass and on the drawer side walls respectively. The invention thus provides a product which limits the extent to which a drawer may be opened, reduces racking and generally enables smoother operation at relatively lower cost than has hitherto been possible.

I claim:

1. A drawer and a cabinet arranged to accommodate said drawer and including an arrangement for smoothly guiding the drawer in and out of the cabinet, the drawer having a length and a weight, the arrangement comprising:

an elongate guiding means secured to at least one side of the cabinet, the elongate guiding means including a stop means at ann end portion thereof, a sliding surface, a rib extending from an edge portion thereof, and a cut-away portion; and a projecting member mounted on a complementary side of the drawer so as to contact the sliding surface thereby to at least partially support the weight of the drawer, said projecting member cooperating with the stop means to limit opening of the drawer to a predetermined position and with the rib to substantially limit lateral movement of the drawer relative to the cabinet, said projecting member cooperating with said cutaway portion of said elongate guiding means such that the projecting member may be lifted clear of the stop means by lifting the front of the drawer, thus allowing removal of the drawer from the cabinet, said projecting member being secured to at least one side of the drawer above a channel running along the length of the side of the drawer, said channel cooperating with the elongate guiding means to support the remaining weight of the drawer; the projecting member and the channel cooperating with the elongate guiding means to substantially limit lateral movement of the drawer relative to the cabinet.

2. The cabinet according to claim 1 in which the elongate guiding means and the projecting member are both formed from a low friction synthetic resin material.

3. The cabinet according to claim 2 in which the drawer is constructed by a vinyl-wrap method.

4. The cabinet according to claim 3 further including a second arrangement for smoothly guiding the drawer in and out of the cabinet; the second arrangement comprising an elongate guiding means including a body secured to a second side opposing said one side of the cabinet and including stop means; the arrangement further comprising a projecting member mounted on the side of the drawer complementary to the second side and arranged to cooperate with the stop means to limit opening of the drawer to a predetermined position.

5. A drawer runner assembly adapted for use with a cabinet and a drawer, said drawer having a horizontal groove along a length of an outer side wall thereof for engaging said runner assembly, said runner assembly comprising:

an elongate runner having front and rear ends and adapted to be secured to a side wall of said cabinet in a substantially horizontal position, said elongate runner having a stepped top surface and a planar lower surface, said stepped top surface including a first elongate upper sliding portion extendable into, and engageable with an upper surface of, said drawer groove, and a second elongate sliding surface laterally adjacent said first sliding surface, said first sliding surface located above said second sliding surface toward front and rear portions of said runner and having a cut-away portion located between said front and rear portions of said runner wherein said first sliding surface is inclined downwardly from said front portion to said rear portion to a location where said first sliding surface ramps down toward said second sliding surface, said second sliding surface terminating in a vertical wall at said front portion of said runner to thereby form an end stop, a rear portion of said lower surface engageable with a lower surface of said groove and a front portion of said lower surface ramping up toward said top stepped surface; and a retaining guide including means for mounting said retaining means on said side wall of said drawer, said retaining guide having a horizontal bearing surface engageable with said second sliding surface of said runner.

6. The drawer runner according to claim 5 wherein said first sliding surface of said runner forms a steering wall positionable within said drawer groove and a side wall of said retaining guide forms a steering projection engageable with said steering wall of said runner for limiting a lateral movement of said drawer relative to said cabinet.

* * * * *

UNITED STATES PATENT AND TRADEMARK OFFICE

CERTIFICATE OF CORRECTION

PATENT NO. : 5,090,787

DATED : February 25, 1992

INVENTOR(S) : David N. HARLEY

It is certified that error appears in the above-identified patent and that said Letters Patent is hereby corrected as shown below:

On the title page:

Please correct the serial number as follows:

[21] Appl. No.: [767,213] 672,136

Signed and Sealed this

Tenth Day of August, 1993

*Attest:*

Michael K. Kirk

MICHAEL K. KIRK

*Attesting Officer*

*Acting Commissioner of Patents and Trademarks*